United States Patent [19]

Kwon

[11] Patent Number: 4,873,454

[45] Date of Patent: Oct. 10, 1989

[54] POWER SOURCE SWITCHING CIRCUIT

[75] Inventor: Hisung Kwon, Seoul, Rep. of Korea

[73] Assignee: Sam Sung Electronic Co. Ltd., Rep. of Korea

[21] Appl. No.: 137,149

[22] Filed: Dec. 23, 1987

[30] Foreign Application Priority Data

Dec. 26, 1986 [KR] Rep. of Korea ..... 86-21232

[51] Int. Cl.[4] ..... H01H 3/26

[52] U.S. Cl. ..... 307/140; 307/130; 307/127; 363/26

[58] Field of Search ..... 307/34, 35, 38, 39, 307/41, 112, 113, 115, 125, 130, 146, 140; 363/65–68; 361/92, 93, 154, 173, 191, 193, 207; 315/171

[56] References Cited

U.S. PATENT DOCUMENTS

| | | | |
|---|---|---|---|
| 3,239,723 | 3/1966 | Washington et al. | 307/130 X |
| 3,467,835 | 9/1969 | Cola | 307/125 |
| 3,560,796 | 2/1971 | Landis | 307/127 X |
| 4,274,122 | 6/1981 | Hansen et al. | 361/13 X |
| 4,360,853 | 11/1982 | Welk | 307/140 X |
| 4,550,272 | 10/1985 | Kimura et al. | 315/171 X |
| 4,581,690 | 4/1986 | Russell | 363/26 X |
| 4,608,498 | 8/1986 | Falzarano et al. | 307/130 X |
| 4,716,301 | 12/1987 | Willmott et al. | 307/115 |

*Primary Examiner*—William M. Shoop, Jr.
*Assistant Examiner*—Paul Ip
*Attorney, Agent, or Firm*—Saidman, Sterne, Kessler & Goldstein

[57] ABSTRACT

A new type of power source switching circuit is disclosed. In the device of the present invention, a relay is used instead of semiconductor elements which are used in the conventional types of power source switching circuit. Compared with the conventional ones, the circuit according to the present invention is much simpler, and assures the protection of the circuit against damages due to an overvoltage or impact pulses, which damages are liable to occur in the conventional types of power source switching circuit.

6 Claims, 2 Drawing Sheets

POWER SOURCE SWITCHING CIRCUIT

FIELD OF THE INVENTION

The present invention relates to a power source switching circuit, particularly to the switching type in which the switching is carried out by controlling the formation of the grounding point for the secondary coil of the transformer by means of relay, in the case where it is desirable to carry out the switching of different power sources by using one single transformer.

BACKGROUND OF THE INVENTION

A general type of switching method using one single transformer for carrying out the switching of different power sources is illustrated in FIG. 1. In the circuit of this type, as the power from an AC power source 1 is applied on the primary coil L11 of the transformer T, power is induced in secondary coils L21–L23. The power induced in the secondary coil L21 is supplied to a regulator IC1 through a bridge type rectifier BR1 consisting of diodes D1–D4, and consequently, the regulator IC1 supplies a constant output power to the microprocessor MP regardless of change of the input load or output load. The said microprocessor has the functions of calculating the value of voltage and deciding the distribution of power to different loads 2–5, while a power source controlling signal output terminal PS supplies program signals to the base terminal of a transistor TR. Here, if a high signal from the power source controlling output terminal PS of the microprocessor MP is supplied to the base terminal of the transistor TR, then the transistor TR is turned on, and so, switching elements SD1, SD2, are also turned on. Consequently, the power induced in the secondary coils L22, L23 of the transformer T is supplied through the bridge type rectifiers BR2, BR3, the switching elements SD1, SD2, and the regulators IC2, IC3 to each of the loads 2–5. Therefore, each of the loads thus supplied with power can perform its functions.

Meanwhile, if a low signal from the power source controlling signal output terminal PS of the microprocessor MP in outputted, the transistor TR is turned off, and also the switching elements SD1, SD2 are turned off. Therefore, the power rectified in the bridge type rectifiers BR2, BR3 cannot be supplied to the regulators IC2, IC3, consequently preventing the power source from being applied to the loads 2–5.

As described above, in the conventional power switching circuit, the power source to be applied to each of loads 2 to 5 is switching over by means of the switching elements SD1, SD2, and, therefore, the volume of the switching elements, including the transistor and logic circuits, is increased. For this reason, the total circuit is accompanied by a great complication, and, furthermore, if an overvoltage or impact pulse is applied, there is the risk that the switching elements can be damaged.

SUMMARY OF THE INVENTION

The present invention is intended to remove the above-described disadvantages. Specifically, a relay is used to control the formation of the grounding contact for the secondary coil of the transformer, where power is induced which is to be switched.

It is the object of the present invention to provide a power source switching circuit in which the said controlling means is used, so that the switching elements are not damaged but carry out normal functions, even if an overvoltage or impact pulse is applied.

It is another object of the present invention to provide a power source switching circuit which is simple in its constitution and easy to manufacture.

DETAILED DESCRIPTION OF THE PREFERRED EMBODIMENT

Now the preferred embodiment of the present invention will be described in more detail with reference to the attached drawings.

Figure 2:
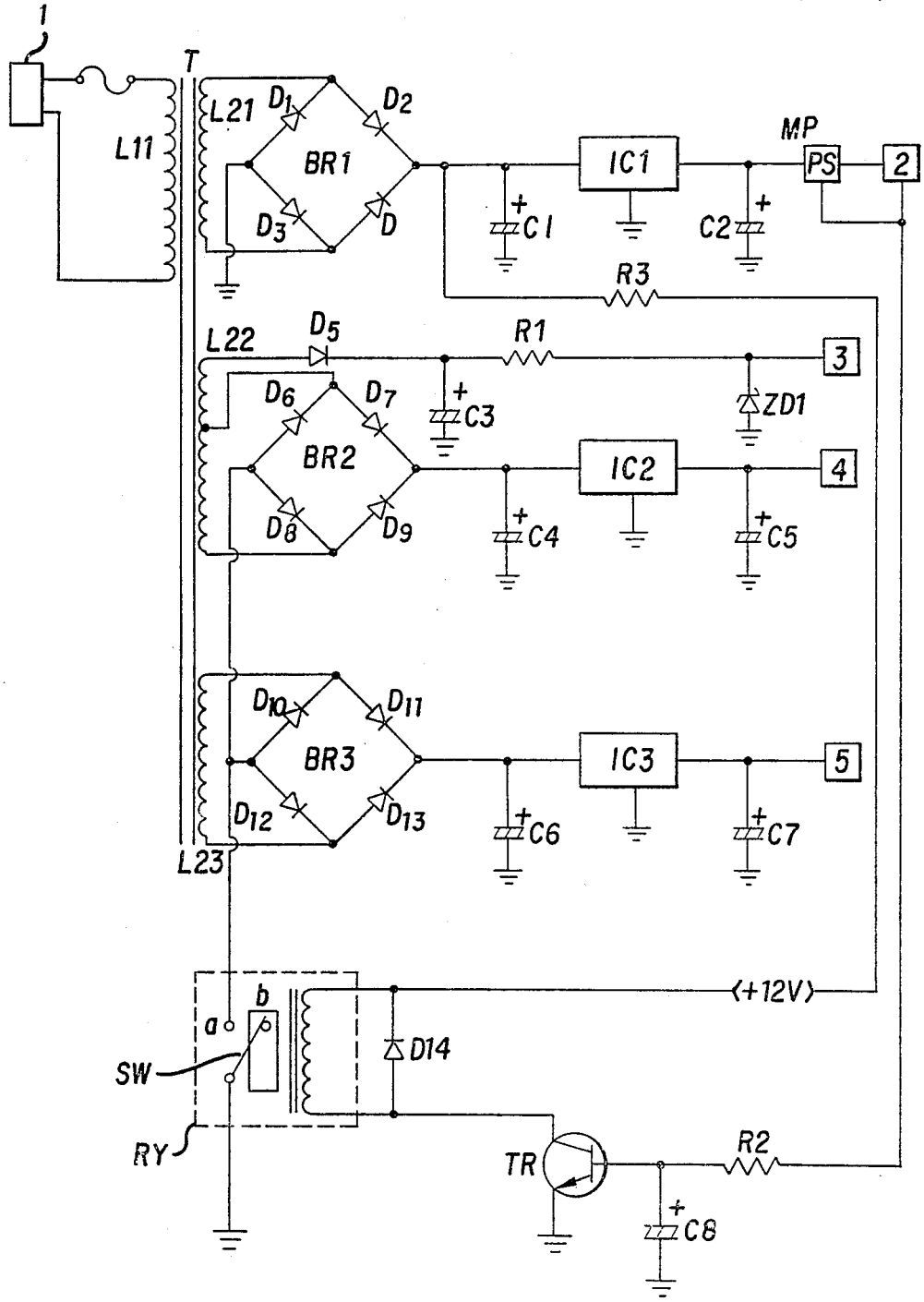
FIG. 2 illustrates the power source switching circuit according to the present invention.

The AC power source 1 is connected to the secondary coil L21 of a transformer T. A first bridge-type rectifier BR1 (composed of diodes D1–D4) is electrically coupled to the transformer T. This first bridge-rectifier BR1 also may be connected to a microprocessor MP and a load 2, as shown in FIG. 2.

The transformer T includes additional secondary coils. The circuit shown in FIG. 2 is depicted with additional secondary coils L22 and L23. Nevertheless, the number of secondary coils provided can easily be varied according to the particular application, and does not form a part of the present invention. Through these additional secondary coils, a plurality of bridge-type rectifiers is electrically coupled to the transformer T in a parallel configuration. For clarification, the phrase "plurality" of bridge-type rectifiers refers to the rectifiers BR2 and BR3 in FIG. 2, and additional rectifiers as the transformer configuration and particular application may require, and does not include the first bridge-type rectifier BR1. All of the rectifiers are electrically coupled to the transformer T in a parallel configuration.

The circuit includes a switching relay RY having a coil and a switch. The switch SW operates between contacts a and b. The plurality of rectifiers (BR2, BR3) is electrically connected, in common, to the switch SW. The switch SW is thus electrically interposed between the plurality of rectifiers and a ground point. In this configuration the relay RY is operative to control the switch SW in accordance with electrical current applied to the coil, thus controlling the application of power to the loads 3, 4, 5. Current may be applied to the coil by connecting the output terminal of the first bridge-type rectifier BR1 through a suitable switch to the coil. Many conventional direct current power supplies would be practical for applying current to the coil.

If a switching transistor TR is used for switching the current applied to the coil, it is connected, via its collector or emitter, to the coil such that the coil and the transistor are connected in a series configuration between a direct current power source (such as the first bridge-type rectifier BR1) and a ground point, as shown. The order in which the coil and transistor are connected is not critical. In this configuration a suitable signal power source, such as the power source controlling signal output terminal PS of the microprocessor MP, is connected to the base terminal of the switching transistor TR through a resistance R2 to which a condenser for electric charge may be connected. The switching transistor TR is operative to control electrical current applied to the coil in accordance with electrical current applied to the base of the switching transistor TR.

Further details of the particular embodiment of the invention depicted in FIG. 2 will now be described.

The secondary coil L22 is connected to a diode D5, a condenser C3, a resistance R1, a load 3 which is operated by means of a rectifying source of a zener diode ZD1.

The said secondary coil L22 is also connected to a condenser C4 and a bridge type rectifier BR2 (composed of diodes D6 to D9), and is also connected to a load 4 which is operated by means of the rectifying source of a regulator IC2.

The secondary coil L23 is connected to a condenser C6 and a bridge type rectifier BR3 (composed of diode D10 to D13), and is also connected to a load 5 which is operated by means of the rectifying source of a regulator IC3. The grounding terminals of the said bridge type rectifiers BR2, BR3 are connected to a contact a of a relay RY.

Figure 1:
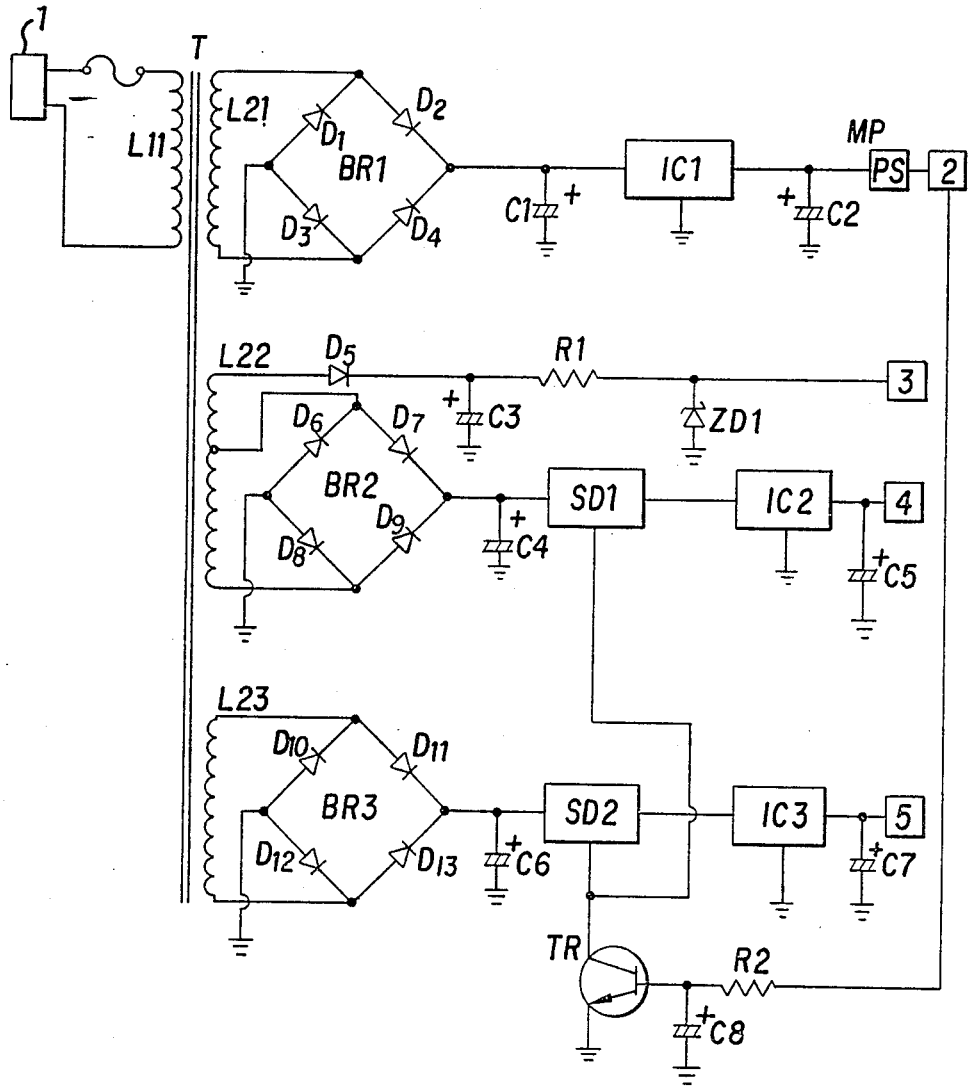
FIG. 1 PRIOR ART
FIG. 1 illustrates a conventional power source switching circuit.

Such are the characteristics of the circuit according to the present invention as shown in FIG. 2, and the parts which have the same functions as those of the parts of FIG. 1 are indicated by the same reference numbers. Therefore, description of such parts is omitted, as it is a mere repetition.

First, if an AC power source is applied from the AC power source 1 to a primary coil L11, the AC power induced in the secondary coil L21 is rectified by means of the bridge type rectifier BR1 composed of the diodes D1 to D4. Then the rectified power is supplied to the regulator IC1, and, in turn, the regulator IC1 supplies a constant DC power to the microprocessor MP, regardless of the variations in the input load or output load. The microprocessor MP operates the load 2 by means of the said DC power, and in the case where the load is to be operated in accordance with a predetermined power source applying program, high level signals from the power source controlling signal output terminal PS are supplied to the base terminal of the transistor TR.

Accordingly, the transistor TR is turned on, and so, the relay coil contained in the relay RY is magnetized, thereby making the relay switch SW contact to the relay switch contact a. This results in that grounding points for the secondary coils L22, L23 of the transformer T are formed.

Therefore, the AC power induced in the secondary coil L22, L23 of the transformer T is rectified by passing through and by means of the regulator IC2 and the bridge type rectifier BR2 (composed of the diodes D6 to D9), the regulator IC3 and the bridge type rectifier BR3, the diode 5, and the zener diode ZD1, in order to ultimately supply the rectified power to the loads 4, 5, 3. Accordingly, the loads 3, 4, 5 can perform the operations according to their functions.

Meanwhile, if the power applying program of the microprocessor MP is put to an inoperable state, a low signal from the power source controlling signal output terminal PS is sent to the base terminal of the transistor TR in order to turn off the transistor TR, thereby preventing the formation of a grounding contact on the relay coil of the relay RY. Accordingly, in such a case, the relay is not magnetized, and so the relay switch SW is connected to the relay contact b, ultimately preventing the grounding contact from being formed on the secondary coil L22, L23 of the transformer T.

As described above, the present invention uses a relay instead of the conventional semiconductor switching elements, such a relay being far stronger in resisting against an overvoltage and impact pulses. Further, such a power source switching device using such a relay is much simpler in its construction compared with that of the conventional ones. Therefore, in the device of the present invention, not only the simplicity of the construction is achieved, but also the apprehension that the circuit may be damaged by an overvoltage or impact pulses is removed.

What is claimed is:

1. Apparatus for switching a power source to supply power to different loads, comprising:
   - a transformer;
   - a first bridge-type rectifier, electrically coupled to said transformer;
   - a plurality of second bridge-type rectifiers, said second bridge-type rectifiers excluding said first bridge-type rectifier, said second bridge-type rectifiers being electrically coupled to said transformer in a parallel configuration;
   - a switching relay having a coil and a switch;
   - said second bridge-type rectifiers being electrically connected, in common, to said switch, said switch being electrically interposed between said second bridge-type rectifiers and a ground point;
   - said switching relay being operative to control said switch in accordance with electrical current applied to said coil.

2. The power source recited in claim 1, wherein:
   - the current to said coil is supplied by said first rectifier.

3. The apparatus recited in claim 1, further comprising:
   - a switching transistor;
   - said transistor and said coil being electrically coupled to a direct current power source such that said coil and said transistor are connected in a series configuration between said power source and a ground point;
   - said transistor being operative to control electrical current applied to said coil in accordance with electrical current applied to the base of said transistor.

4. The apparatus recited in claim 3, wherein said direct current power source comprises said first bridge-type rectifier.

5. Apparatus for switching a power source to supply power to different loads, comprising:
   - a transformer;
   - a first bridge-type rectifier, electrically coupled to said transformer;
   - a plurality of second bridge-type rectifiers, said second bridge-type rectifiers excluding said first bridge-type rectifier, said second bridge-type rectifiers being electrically coupled to said transformer in a parallel configuration;
   - a switching relay having a coil and a switch;
   - said first bridge-type rectifier and said second bridge-type rectifiers having a first end, and a second end to which said different loads are connected,
   - said first end of said second bridge-type rectifiers being responsive to said switch, said switch being electrically interposed between said second bridge-type rectifiers and a ground point;

said relay being operative to control said switch in accordance with electrical current applied to said coil.

6. Apparatus for switching a power source to supply power to different loads, comprising:

a transformer;

a first bridge-type rectifier, electrically coupled to said transformer;

a plurality of second bridge-type rectifiers, said second bridge-type rectifiers excluding said first bridge-type rectifier, said second bridge-type rectifiers being electrically coupled to said transformer in a parallel configuration;

a switching relay having a coil and a switch;

said second bridge-type rectifiers being directly electrically connected, in common, to said switch, said switch being electrically interposed between said second bridge-type rectifiers and a ground point;

said relay being operative to control said switch in accordance with electrical current applied to said coil.

* * * * *